United States Patent [19]

Pessina et al.

[11] 4,421,221

[45] Dec. 20, 1983

[54] REVOLVING TABLE FOR BOOK-BINDING STACKERS AND THE LIKE

[76] Inventors: Giorgio Pessina; Aldo Perobelli, both of Paderno Dugnano, Milano, Italy

[21] Appl. No.: 345,416

[22] Filed: Feb. 3, 1982

[30] Foreign Application Priority Data

Feb. 6, 1981 [IT] Italy ..... 19561 A/81

[51] Int. Cl.[3] ..... B65H 31/30

[52] U.S. Cl. ..... 198/372; 198/748; 414/31; 414/46; 414/65

[58] Field of Search ..... 414/17, 31, 46, 65, 414/66, 516; 198/372, 374, 411, 412, 457, 747, 748

[56] References Cited

U.S. PATENT DOCUMENTS

| | | | |
|---|---|---|---|
| 3,054,516 | 9/1962 | Joa | 414/46 X |
| 3,381,829 | 5/1968 | Turner | 414/46 X |
| 3,640,407 | 2/1972 | Anastasio et al. | 414/46 X |
| 4,103,785 | 8/1978 | Wiseman | 414/46 X |
| 4,229,134 | 10/1980 | Reist | 414/46 |

FOREIGN PATENT DOCUMENTS

| | | | |
|---|---|---|---|
| 2733464 | 12/1978 | Fed. Rep. of Germany | 198/412 |
| 273719 | 9/1970 | U.S.S.R. | 198/747 |

*Primary Examiner*—Leslie J. Paperner

*Attorney, Agent, or Firm*—Kirschstein, Kirschstein, Ottinger & Cobrin

[57] ABSTRACT

An improved revolving table intended for stackers as utilized in book-binding shops and the like, has a pusher reciprocating arrangement which is accommodated in the table structure, the pusher being, at its travel limit positions, located on the surface of the revolving table. The table is formed with a slot in the diametrical direction, and has, depending therefrom, a hollow beam accommodating the pusher reciprocating arrangement. For a given stack size, lower bulk dimensions can be achieved for the stacker.

6 Claims, 4 Drawing Figures

REVOLVING TABLE FOR BOOK-BINDING STACKERS AND THE LIKE

BACKGROUND OF THE INVENTION

This invention relates to an improved revolving table for book-binding stackers and the like.

As is known, stackers are machines positioned downstream of book-binding equipment, such as collators, where they function to form stacks of sheets, signatures, pamphlets, brochures, or the like, upon arrival from said book-binding equipment.

Since, in the instance of brochures or signatures, the same would have a back or spine side which assumes a larger thickness dimension along the fold side than the remaining portions of the brochures or signatures, in order to avoid the formation of fanned-out, and consequently unstable, stacks, it is common practice to lay the stacks onto a revolving table which can be rotatively reciprocated through 180 degrees and, upon the formation of each single layer in the stacks, is rotated by 180° to form the next layer. Arranged orthogonally to the direction of arrival of the signatures or the like, a conveyor belt is associated with the system for the removal of the completed stacks. To transfer the stacks from the revolving table onto the stack removing conveyor belt, in a conventional construction, a cylinder-piston unit is associated with the stationary stacker frame, the free end of the piston rod whereof has a pusher secured thereto, which pusher is, in its inoperative or home position, located in front of the revolving table, substantially on the same plane as the table.

Said cylinder-piston unit extends in the direction of movement of the stack conveyor belt and sticks out of the stacker frame in cantilever relationship therewith.

The pusher performs its movements on the revolving table.

Such prior stackers have several deficiencies and disadvantages, among which the following stand out.

(a) The stacker bulk dimensions are increased considerably by the provision of the cantilevered cylinder-piston unit for actuating the pusher. This entails increased space requirements in a book-binding environment where, as is well known, space is at a premium and not always available.

(b) Since the pusher is external to the revolving table and separate from it, the result is that the revolving table must be allowed fairly large overall dimensions to prevent the pusher, while stationary, from interfering with the stack corners during the table rotation. This reflects, on one hand, in a further increase of the stacker size, and on the other hand, in the need for a longer stack-ejecting stroke of the pusher.

(c) Upon completion of the stack-ejecting stroke, the pusher must be returned to its initial position, before another stack-ejecting stroke can take place. Therefore, each stack-ejecting stroke is followed by an idle, that is inactive, stroke. This, of course, considerably reduces the number of stack-ejecting cycles per unit time.

(d) It is only possible to eject the stacks in one direction, that is in the pusher direction of movement. This involves the use of a single conveyor for stack removal, whereas in many cases it would be desirable to use two or more stack conveyor belts set at an angle to each other, e.g. at 90° or 180°.

(e) The procedure for adapting a stacker to its associated book-binding machine, e.g. a collator, or to get the oncoming stacks aligned, requires several manual operations and a number of movable parts.

SUMMARY OF THE INVENTION

This invention is directed to provide an improved revolving table, as indicated, which can obviate the aforementioned disadvantages.

This object is achieved, according to the invention, by an improved revolving table for book-binding stackers and the like, having a means for driving said table rotatively, a pusher movable to eject stacks and associated therewith a means for driving said pusher, and conventional movable stack positioners, characterized in that said pusher is supported on said table for reciprocation between two travel limit positions located on the surface of said revolving table, there being preferably provided pusher guiding means and a means for reciprocating said pusher preferably incorporated with said table, and a means for step rotating said table.

The proposed solution affords the advantage that each stroke of the pusher can be a useful stack ejecting stroke, as well as the advantage of considerably reducing the bulk dimensions of the stacker with respect to conventional stackers having the pusher actuating cylinder-piston unit associated externally to the stacker in cantilever relationship therewith.

A further important advantage afforded by the proposed solution is that, for ejecting the stacks, one or more of the stacker three sides may be utilized as desired, with the sole exception of the side receiving the signatures from the collator, or the like machine.

Yet another advantage of this improved revolving table is that the table can be accommodated in existing stackers, with but a few alterations.

Furthermore, through the solution herein proposed, it becomes possible to considerably increase the stack ejection speed, which reflects in the possibility of operating the feeding machine, such as a collator, at its optimum speed for an improved output of the same. This is made possible by that the pusher is always located within the table structure, thereby a shorter stroke is required for the ejection. Moreover, for a given maximum size of the stack, with the inventive solution, the table can be made smaller than conventional ones, because the pusher, which in accordance with the invention is positioned on the table, can now occupy a surface portion of the table left free by the stack, so that it is prevented from hitting the corners of the stack itself while the latter, or the table, is being rotated.

An additional advantage of the invention is to be found in the simple and quick effectuation of the signature or the like centering operations, since it will be sufficient to shift the table horizontally without manipulation of the pusher or actuating means therefor.

BRIEF DESCRIPTION OF THE DRAWINGS

Further features and advantages of the improved revolving table according to this invention will be more clearly understood from the following detailed description, with reference to the accompanying drawings, where the table is illustrated schematically and to different scales, and where.

DESCRIPTION OF THE PREFERRED EMBODIMENT

Figure 1:
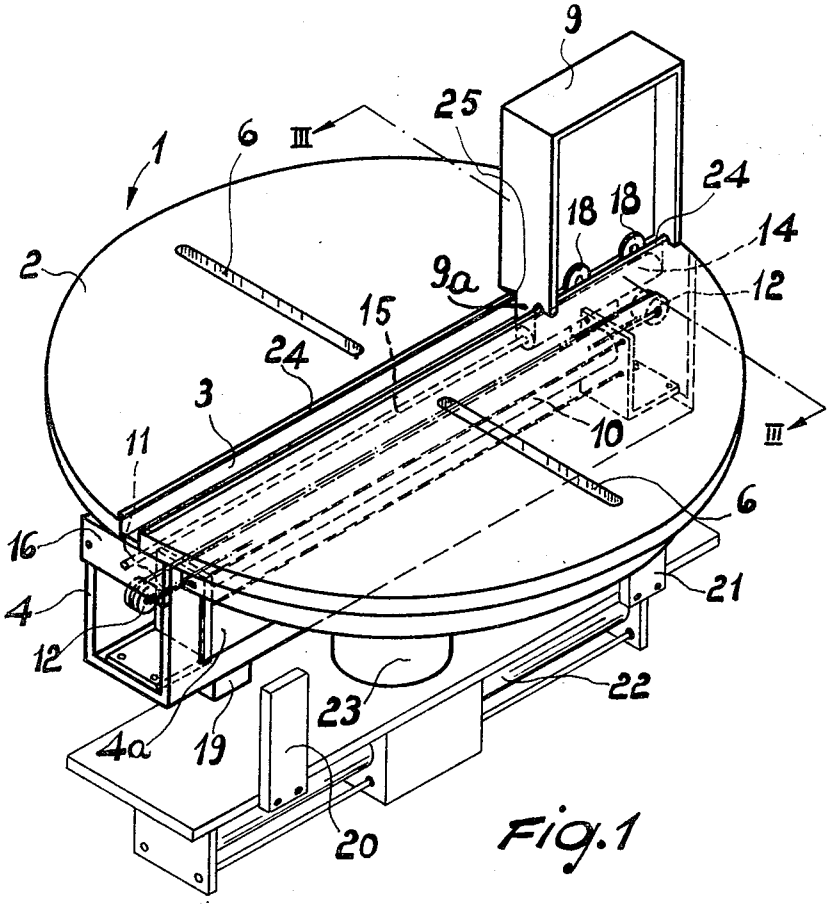
FIG. 1 is a top perspective view of a table according to the invention.

With reference to the drawing figures, where similar parts have been designated with the same reference characters, the improved revolving table of this invention is generally indicated at 1. It comprises a table body 2, which in the embodiment shown, is a single-piece casting. Said body 2 is formed with a diametrical throughgoing slot 3 and provided, at the bottom and juxtaposed to said slot 3, with a hollow beam 4 extending parallel to the slot 3 across the axis of the table body 2 and having windows 4a for lightening purposes. Located transversely to the beam 4, on the bottom side of the table body 2, are opposed lateral surfaces 5, which will be described hereinafter. Through the body 2, and centrally with respect to said lateral surfaces 5, there are formed two diametrically extending slots 6, through which slots are passed respective strip supports 7 for a movable side stack locator or positioner, indicated at 8. The positioner 8 and related support and driving means accommodated between the lateral surfaces 5 are no further described herein, because known per se and foreign to this invention.

Figure 3:
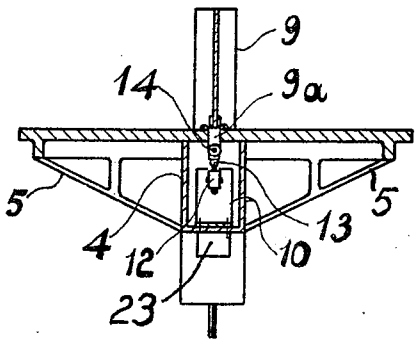
FIG. 3 is a cross-sectional view taken along the line III—III of FIG. 1.

The pusher is indicated at 9. The means for reciprocating it comprises, in the embodiment shown in FIGS. 1–3, a cylinder-piston unit 10 carried within the beam 4 and extending in the direction of the beam 4. The unit 10 has a flexible drive element, such as a rope-like one, which is passed, at the two ends of the unit 10 adjacent the ends of the beam 4, around rotatably supported end pulleys 12 and connected, with its free ends, to the piston ends, in a manner no further illustrated. The movement of the piston will cause a corresponding displacement of the drive rope 11, to which rope there is attached, such as by means of a screw-actuated fastening element 13, a tubular projection 14 which is integral with the pusher 9 and slidable on a guiding rod 15, the latter extending within the slot 3 parallel thereto and being supported on end plates 16 fastened, with screws 17, to the hollow beam 4 at the ends thereof. The reference numeral 18 designates rolling wheels mounted laterally to the pusher 9.

On the bottom side of the hollow beam 4, the latter is provided with a projection 19 acting as a stop element cooperating with fixed stop elements 20;21 for limiting the table rotation and being known per se and only shown schematically. These will be equipped with conventional shock absorbing elements, not shown. In the embodiment being considered, the two stops 20,21 allow for a rotational reciprocation of the table 1 through 180 degrees in normal operation. The table is rotatively driven, in this embodiment, by means of a conventional cylinder-piston unit 22 which is supported on the stacker stationary frame, and has a gear segment in mesh engagement with a pinion keyed to the shaft of the revolving table 1 in a manner known per se and no further illustrated.

The reference numeral 23 designates a rotating cylindrical distributor arranged centrally of the table 1 below the cylinder-piston unit 10 and the beam 4 for supplying compressed air to the cylinder-piston unit 10. The distributor 23, which is coaxial to the table body 2, may be of any selected types.

Figure 2:
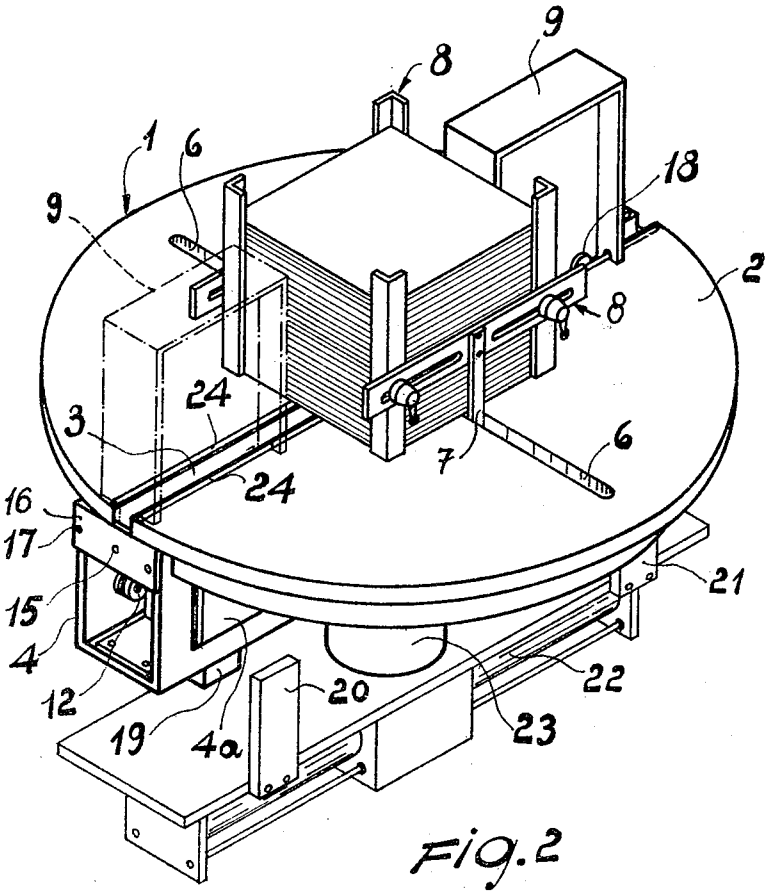
FIG. 2 is a top perspective view of a table, similar to FIG. 1, including a stack and pusher.

In the exemplary embodiment illustrated, there is indicated at 9a in FIG. 1 a strip projection of the pusher 9 which forms the tubular portion 14 at its free end. At 24 are indicated two conventional guiding rod-like elements which are secured to the top side of the table body 2 along the longitudinal edges of the slot 3 for the purpose of imparting, to a stack being formed, a slightly sagging configuration effective to facilitate the ejection of the stack. The pusher 9 is provided with corresponding depressions or seats 25 for riding on the rod-like elements 24. The pusher is advantageously a hollow, or perforated, construction of parallelepipedal shape for lightening purposes.

By providing advantageously, instead of the cylinder-piston unit 22, a stepped motor associated with a programming unit, it becomes possible to selectively rotate the table 1 in accordance with a desired stack ejection program.

The operation of the improved revolving table of this invention will be readily appreciated from the foregoing description.

After a stack has been formed, the pusher 9 will provide for the ejection of the stack by actuation of the cylinder-piston unit 10. The movement of the piston of said unit 10 produces a corresponding displacement of the rope drive element 11, and accordingly, of the pusher 9 across the axis of the table body 2. Upon completion of an ejection stroke, the formation of a fresh stack can be immediately initiated without completing any prior idle return stroke of the pusher 9. After completion of a stack, if the latter is to be ejected in the opposite direction to the direction of ejection of a preceding stack, it will be sufficient to actuate the unit 10 and produce the ejection stroke of the pusher 9. Where, instead, the stack is to be ejected in the same direction as the preceding stack, the table is rotated, with a quickly effected operation, through 180°, whereafter the stack ejection stroke can take place. Whether, on each occasion, a 180° rotation or the effectuation of an idle return stroke (which would in all cases be shorter than with prior machines) may be more appropriate, is a decision which will depend on the speeds of rotation of the table and displacement of the pusher specifically attainable.

By providing, instead of the unit 22, a stepped motor and associated programming unit, which components are individually well known in the art, it becomes possible to effect each time any desired step rotation movements and to eject the stacks along different selected directions angularly related to one another.

Figure 4:
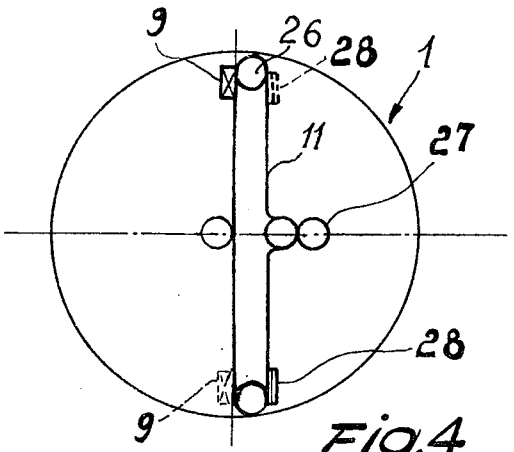
FIG. 4 is a top general view showing diagramatically a table with a pusher associated with a closed loop drive chain.

In the modification of FIG. 4, the means for reciprocating the pusher 9 comprises a closed-loop chain 11 run around two sprocket wheels 26 and driven by a sprocket 27 that is rotated by an electric motor, or rack and pinion device, or pairs of driving wheels with intervening friction clutches, or the like, in quite a conventional manner no further discussed herein. The reference numeral 28 diagrammatically designates a counterweight attached to the chain 11 for balancing the pusher 9 as the table is being rotated. In fact, when the pusher 9 is in the position shown by full lines in FIG. 4, the counterweight 28 is in the position shown by full lines, i.e. substantially diametrically opposite to the pusher 9 such as to balance the centrifugal force acting on the pusher 9 during rotation of the table 1. A similar balancing action occurs when the pusher 9 and counterweight 28 are in the positions shown by dotted lines. The closed-loop chain 25 could obviously be arranged to lay in a vertical rather than horizontal plane.

It will be appreciated from the foregoing that the invention achieves its object in a most effective way, and that the advantages specified in the preamble can be achieved. In particular, the construction is simplified, dimensions are reduced, and the operating speed is increased.

Substantial to the invention is the provision for the pusher of stroke limit positions on the table itself. In practicing the invention, individual parts may be replaced with other technically and functionally equivalent parts; thus, for example, for the guiding element of the pusher 9, a single profile section rod, or two parallel rods, may be provided, etc., without departing from the true scope of the invention.

Furthermore, the pusher driving means may be provided in the form of a rod type of drive element adapted to engage with the upper portion of the pusher 9.

While the table body 2 has been described as formed by casting, the same may also be constructed as an assembly of separate parts connected together, such as by welding.

We claim:

1. A revolving table for book-binding stackers and the like, comprising a table body, a movable stack positioner on said table body, a pusher on said table body for ejecting stacks previously positioned by said stack positioner on said table body, means for moving said pusher and means for stepwise rotating said table body about an axis of said table body to eject said stacks according to selected directions, wherein said means for moving said pusher comprise a diametrical slot in said table body, a hollow beam fastened to said table body below thereof and extending across said axis of said table body parallel to said slot, a cylinder-piston unit arranged within said hollow beam and extending in the direction of said hollow beam, a drive means secured to said pusher and said piston within said hollow beam and operable by said piston, a means for guiding said pusher along said slot, and means arranged centrally of said table body below said cylinder-piston unit and said hollow beam for supplying compressed air to said cylinder-piston unit for reciprocating said drive means across said axis of said table body.

2. A revolving table according to claim 1, wherein said means for guiding said pusher along said slot comprises a guiding rod arranged within said slot parallel thereto and supported by end plates fastened to said hollow beam at opposite ends thereof, and a tubular projection integral with said pusher and slidable on said guiding rod.

3. A revolving table according to claim 1, further comprising guiding rod-elements secured to said table body along longitudinal edges of said slot for imparting a sagging to said stack, wherein said pusher has corresponding seats for riding on said guiding rod-like elements.

4. A revolving table according to claim 1, wherein said means for supplying compressed air to said cylinder-piston unit comprise a cylindrical distributor arranged coaxially to said table body.

5. A revolving table according to claim 1, wherein said pusher is a hollow parallelepipedal body.

6. A revolving table according to claim 1, further comprising a stop projection secured to a bottom side of said hollow beam for cooperation with fixed stop elements to limit rotation of said table body.

* * * * *